US010946667B2

(12) United States Patent
Maeshima

(10) Patent No.: US 10,946,667 B2
(45) Date of Patent: Mar. 16, 2021

(54) IMAGE FORMING APPARATUS AND INK CONTAINER

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/673,051

(22) Filed: Nov. 4, 2019

(65) Prior Publication Data

US 2020/0139722 A1 May 7, 2020

(30) Foreign Application Priority Data

Nov. 7, 2018 (JP) ..... JP2018-209742

(51) Int. Cl.
*B41J 2/175* (2006.01)
*B41J 2/185* (2006.01)
*B41J 2/17* (2006.01)

(52) U.S. Cl.
CPC ..... *B41J 2/185* (2013.01); *B41J 2/1721* (2013.01); *B41J 2/1752* (2013.01); *B41J 2002/1856* (2013.01)

(58) Field of Classification Search
CPC .. B41J 2/1752; B41J 2/17523; B41J 2/17553; B41J 2/17509; B41J 29/13
See application file for complete search history.

(56) References Cited

U.S. PATENT DOCUMENTS 5,805,187 A * 9/1998 Sasaki ..... B41J 2/1752 347/86
5,841,453 A * 11/1998 Sasaki ..... B41J 2/04 347/86

FOREIGN PATENT DOCUMENTS

| | | | | |
|---|---|---|---|---|
| AU | 2003204751 B2 | | 7/2008 | |
| AU | 2006201249 B2 | | 1/2009 | |
| AU | 2004203638 B2 | | 4/2010 | |
| EP | 0572834 A2 | * | 12/1993 | ..... G11B 23/08778 |
| JP | 2004074773 A | | 3/2004 | |
| JP | 2014002299 A | * | 1/2014 | |

* cited by examiner

*Primary Examiner* — Sharon Polk
(74) *Attorney, Agent, or Firm* — Studebaker & Brackett PC

(57) ABSTRACT

An image forming apparatus includes a container guide and a latch mechanism. The latch mechanism includes a pin and a pin supporting member. The latch mechanism permits an attachment of the ink container to the container guide when the ink container is pushed in an attachment direction and the pin is stored in a first storage part and permits a detachment of the ink container from the container guide when the ink container attached to the container guide is pushed in the attachment direction and the pin is removed from the first storage part. The pin supporting member includes a boss. The boss is stored in a second storage part when the pin is stored in the first storage part, and the boss is removed from the second storage part when the pin is removed from the first storage part.

7 Claims, 17 Drawing Sheets

IMAGE FORMING APPARATUS AND INK CONTAINER

INCORPORATION BY REFERENCE

This application is based on and claims the benefit of priority from Japanese patent application No. 2018-209742 filed on Nov. 7, 2018, which is incorporated by reference in its entirety.

BACKGROUND

The present disclosure relates to an inkjet type image forming apparatus and an ink container.

In an inkjet type image forming apparatus, an ink container is replaced to replenish an ink. The ink container is attached to an ink container storage part provided in an apparatus main body of the image forming apparatus.

A technique for facilitating the replacement of the ink container is discussed. For example, an inkjet recording apparatus (an image forming apparatus) is known, which is configurated such that an ink cartridge (the ink container) is pushed into a cartridge holder (the container storage part) to make it possible to attach and detach the ink cartridge. The cartridge holder is provided with a projection for fixing and the ink cartridge is provided with a fixing member. When the ink cartridge is pushed in by hand against an elastic force of a spring, the projection reaches a back side dead point of a recess of the fixing member. When the hand is released from the ink cartridge, the ink cartridge is moved in an opposite direction to the insertion direction by the elastic force of the spring and the projection is engaged with a holding portion of the fixing member. On the other hand, when the ink cartridge is replaced, the ink cartridge is pushed in against the elastic force of the spring, the projection is guided by a back protrusion of the recess of the fixing member and gets over an inclined face, and when the hand is released from the ink cartridge, the ink cartridge is moved upward by the elastic force of the spring to release the restriction.

However, in the above configuration, because a load concentrates on the projection for fixing, the projection may be deformed or damaged. Additionally, if the ink container has a wide width in a direction perpendicular to the insertion direction, the ink container may be easily inclined.

SUMMARY

In accordance with an aspect of the present disclosure, an image forming apparatus includes a container guide and a latch mechanism. The container guide guides an ink container storing an ink supplied to a recording head in a predetermined attachment direction to be attached. The latch mechanism includes a pin and a pin supporting member. The pin protrudes toward one face of the ink container. The pin supporting member supports the pin and is supported by the container guide in a movable manner in a direction parallel to the one face and crossing to the attachment direction. The latch mechanism permits an attachment of the ink container to the container guide when the ink container is pushed along the container guide in the attachment direction and then the pin is stored in a first storage part formed in the ink container and permits a detachment of the ink container from the container guide when the ink container attached to the container guide is pushed in the attachment direction and then the pin is removed from the first storage part. The pin supporting member includes a boss protruding toward the one face of the ink container. The ink container includes a second storage part formed on the one face of the ink container. The boss is stored in the second storage part when the pin is stored in the first storage part, and the boss is removed from the second storage part when the pin is removed from the first storage part.

In accordance with an aspect of the present disclosure, an ink container is attached to an image forming apparatus. The image forming apparatus includes a container guide, a latch mechanism and a boss. The container guide guides the ink container storing an ink supplied to a recording head in a predetermined attachment direction to be attached. The latch mechanism includes a pin and a pin supporting member. The pin protrudes toward one face of the ink container. The pin supporting member supports the pin and is supported by the container guide in a movable manner in a direction parallel to the one face and crossing to the attachment direction. The latch mechanism permits an attachment of the ink container to the container guide when the ink container is pushed along the container guide in the attachment direction and then the pin is stored in a first storage part formed in the ink container and permits a detachment of the ink container from the container guide when the ink container attached to the container guide is pushed in the attachment direction and then the pin is removed from the first storage part. The boss is formed in the pin supporting member so as to protrude toward the one face of the ink container. The ink container includes a first storage part and a second storage part formed on the one face of the ink container. The boss is stored in the second storage part when the pin is stored in the first storage part, and the boss is removed from the second storage part when the pin is removed from the first storage part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus and an ink container according to one embodiment of the present disclosure will be described with reference to the drawings.

Figure 1:
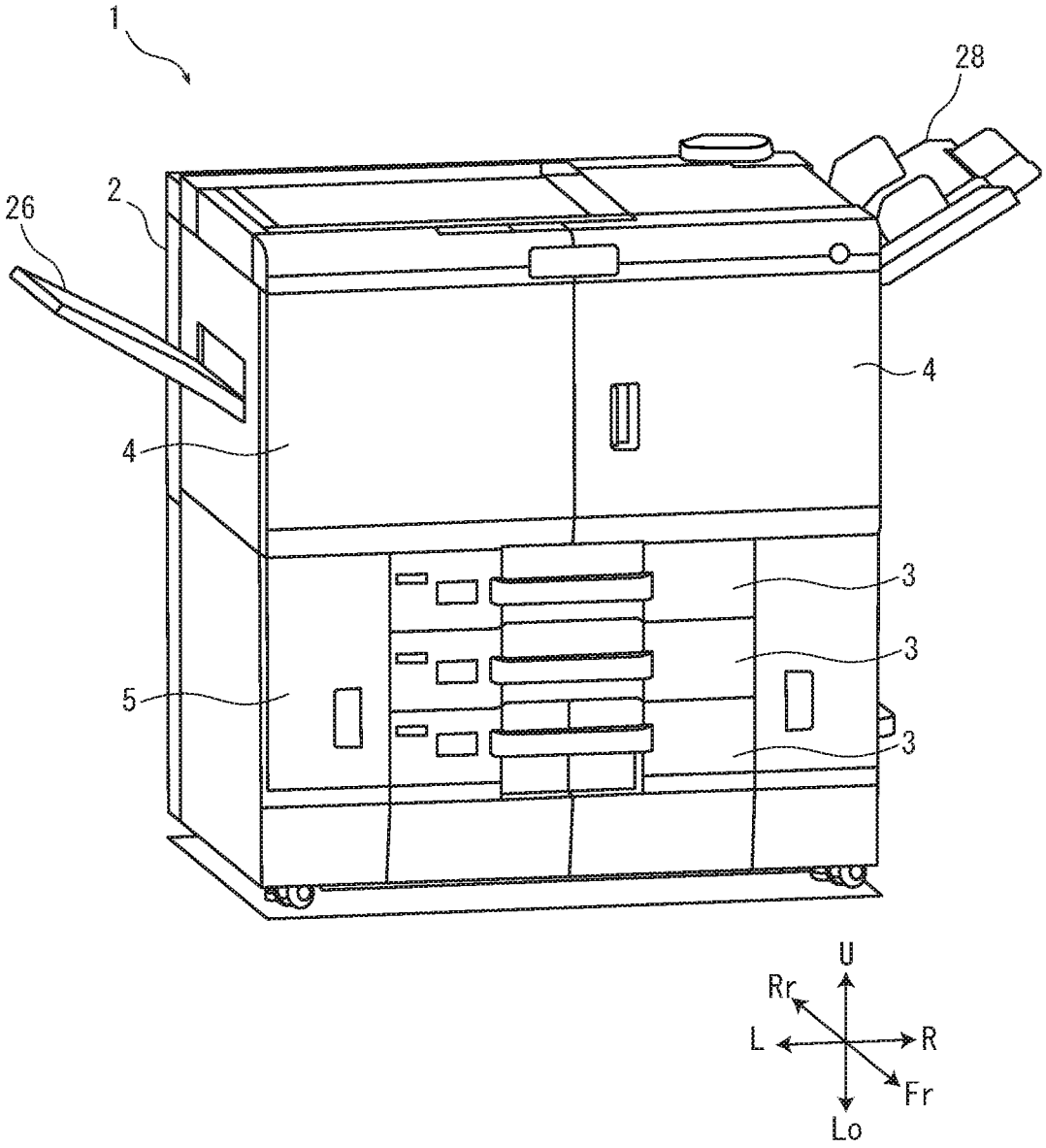
FIG. 1 is a perspective view showing an appearance of a printer according to one embodiment of the present disclosure.
Figure 2:
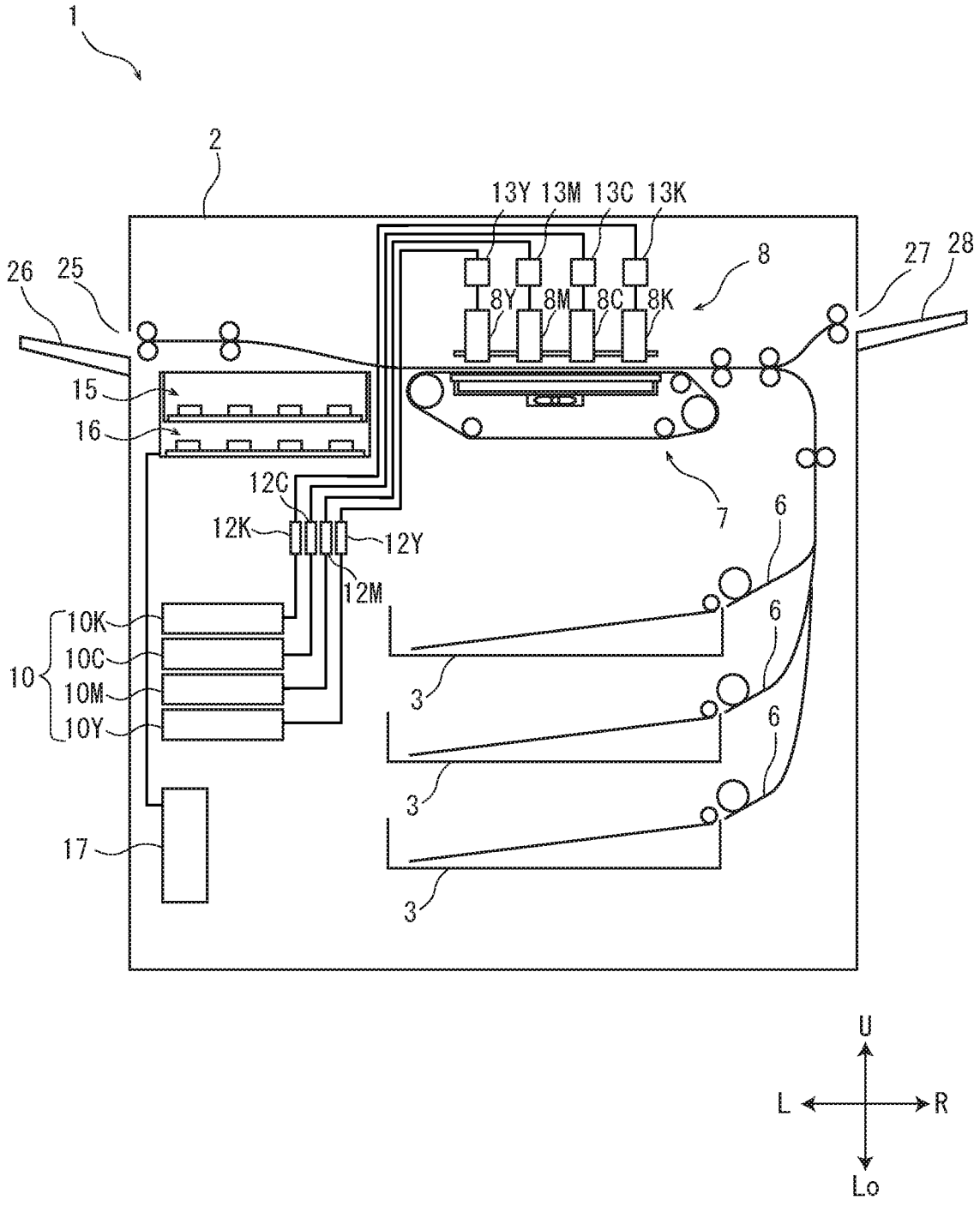
FIG. 2 is a front view schematically showing an inner structure of the printer according to the embodiment of the present disclosure.
Figure 3:
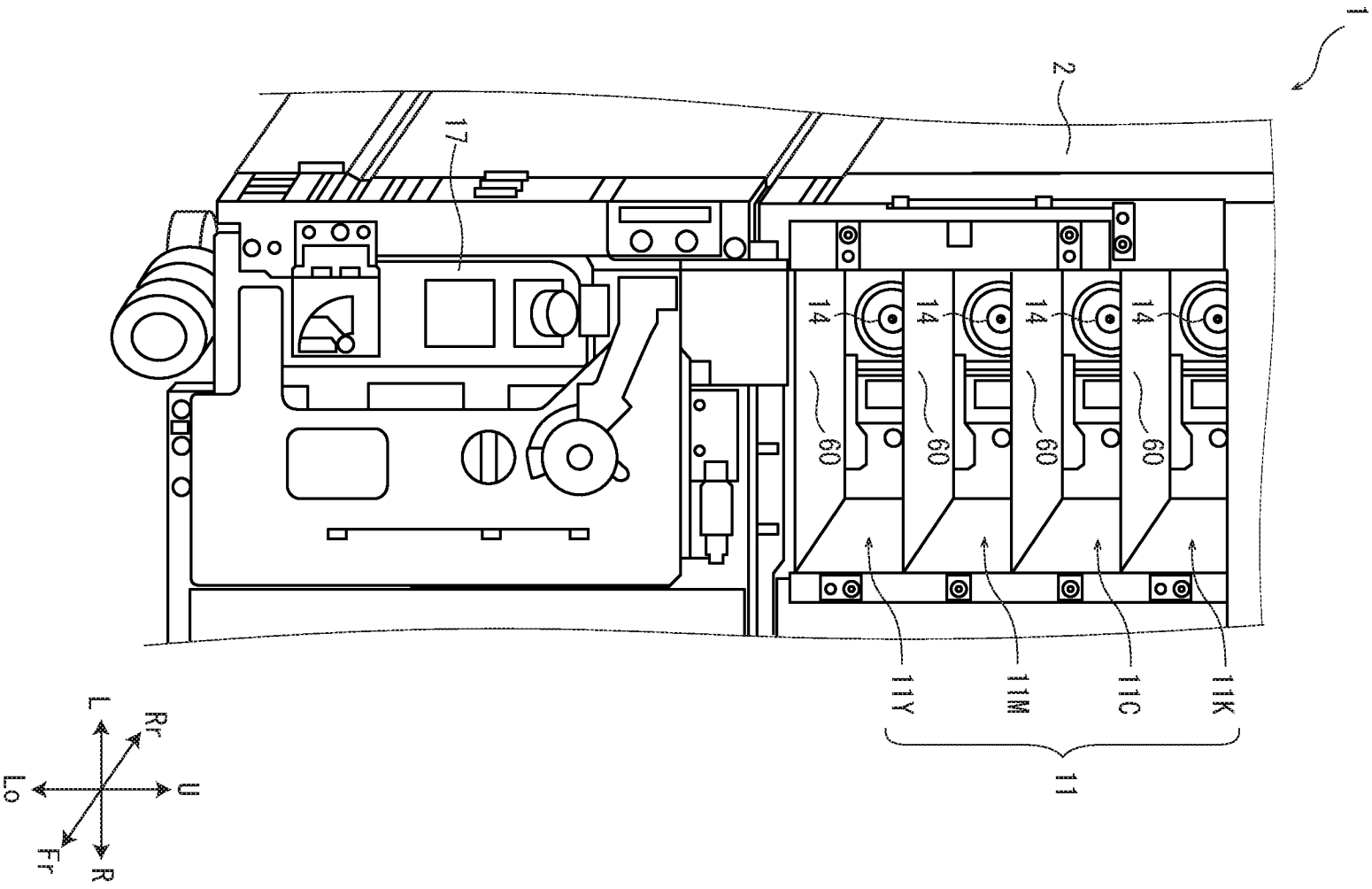
FIG. 3 is a perspective view showing the printer whose inside is exposed by opening a left lower cover, according to the embodiment of the present disclosure.

Firstly, with reference to FIG. 1 to FIG. 3, an entire structure of a printer 1 (an example of the image forming apparatus) will be described. FIG. 1 is a front view schematically showing an appearance of the printer 1. FIG. 2 is a front view schematically showing an inner structure of the printer 1. FIG. 3 is a perspective view showing the printer 1 whose inside is exposed by opening a left lower cover 5. In the following description, a front side on a paper surface in FIG. 1 to FIG. 3 is defined as a front side of the printer 1, and the left-and-right direction is based on a direction where the printer 1 is viewed from the front side. In each figure, U, Lo, L, R, Fr and Rr respectively show an upper, a lower, a left, a right, a front and a rear.

The printer 1 includes a box-like shaped housing 2. In the lower portion of the front face of the housing 2, a plurality of drawable sheet feeding cassettes 3 is provided. On the upper portion of the front face of the housing 2, an openable and closable upper side cover 4 is provided. On the left lower portion of the front face of the housing 2, the openable and closable left lower side cover 5 is provided.

As shown in FIG. 2, in the upper portion of the housing 2, recording heads 8K, 8C, 8M and 8Y are provided. The recording heads 8K, 8C, 8M and 8Y are line heads which eject inks of black, cyan, magenta and yellow, respectively. Hereinafter, the recording heads 8K, 8C, 8M and BY are collectively called the recording head 8.

On the upper portion of the left side face of the housing 2, a discharge port 25 is provided, and a discharge tray 26 is provided below the discharge port 25. A conveyance path 6 is formed from the sheet feeding cassettes 3 to the discharge port 25 through an image forming part 8. On the upper portion of the right side face of the housing 2, a manual bypass sheet feeding port 27 is provided, and a manual bypass tray 28 is provided below the manual bypass sheet feeding port 27.

A sheet conveyance unit 7 is disposed at a position facing the recording head 8 via the conveyance path 6. The sheet conveyance unit 7 includes an endless conveyance belt wound around a drive roller, a driven roller and a tension roller, and is movable upwardly and downwardly between an image forming position where the sheet conveyance unit 7 is close to the recording head 8 and a retracting position where the sheet conveyance unit 7 separates from the recording head 8. The sheet conveyance unit 7 is moved to the image forming position when an image forming operation is performed, and moved to the retracting position when the image forming operation is not performed. The conveyance belt has a plurality of air suction holes, and an air suction part is provided at a position facing the recording head 8 via the conveyance belt. The air suction part generates an air flow from a space above the conveyance belt through the air suction holes to the inside of the conveyance belt to suck the sheet to the conveyance belt.

When the left lower cover 5 is opened, as shown in FIG. 3, container storage parts 11K, 11C, 11M and 11Y are exposed. To the container storage parts 11K, 11C, 11M and 11Y, ink containers 10K, 10C, 10M and 10Y are attached respectively. The ink containers 10K, 10C, 10M and 10Y store inks of black, cyan, magenta and yellow, respectively. Hereinafter, the ink containers 10K, 10C, 10M and 10Y are collectively called the ink container 10, and the container storage parts 11K, 11C, 11M and 11Y are collectively called the container storage part 11. In the rear portion of the container storage part 11, a connection port 14 to which the ink container 10 is connected is provided. The container storage part 11 includes a container guide 60 which guides the ink container 10 to be attached and supports the attached ink container 10.

As shown in FIG. 2, between the container storage parts 11K, 11C, 11M and 11Y and the respective recording heads 8K, 8C, 8M and 8Y, individual ink supply paths are formed. The ink supply path of the black ink is provided with a pump 12K and a sub ink tank 13K. The pump 12K pumps up the ink from the ink container 10K and sends the ink to the sub ink tank 13K. The sub ink tank 13 stores a predetermined amount of the ink, and supplies the ink to the recording head 8K. The ink supply paths of the cyan, magenta and yellow inks have the same structure as the ink supply path of the black ink. That is, the ink supply path between the container storage part 11C and the recording head 8C is provided with a pump 12C and a sub ink tank 13C, the ink supply path between the container storage part 11M and the recording head 8M is provided with a pump 12M and a sub ink tank 13M, and the ink supply path between the container storage part 11Y and the recording head 8Y is provided with a pump 12Y and a sub ink tank 13Y.

A cap unit 15 and a wiper unit 16 are provided in the left upper portion of the inside of the housing 2. The cap unit 15 and the wiper unit 16 are disposed at a waiting position on the left side of the sheet conveyance unit 7 when the image forming operation is performed. When the image forming operation is not performed, the sheet conveyance unit 7 is moved to the retracting position, and one of the cap unit 15 and the wiper unit 16 is moved to a processing position between the sheet conveyance unit 7 and the recording head 8.

The cap unit 15 is provided with a cap member, and covers the recording head 8 with the cap member when moved to the processing position. The wiper unit 16 is provided with a wiper member and a waste ink tray, and the wiper member and the waste ink tray are disposed below the recording head 8 when the wiper unit 16 is moved to the processing position. At this time, a purge processing and a cleaning processing are subjected to the recording head 8, and a waste ink resulted from the purge processing and the cleaning processing is stored in the waste ink tray.

A waste ink tank 17 is provided below the ink container 10. The waste ink tank 17 is connected to the waste ink tray of the wiper unit 16. The waste ink resulted from the purge processing and the cleaning processing is dropped on the waste ink tray and then stored in the waste ink tank 17.

When a maintenance operation for the sheet conveyance unit 7, the cap unit 15 and the wiper unit 16 is performed, the upper cover 4 is opened.

Next, the image forming operation of the printer 1 will be described. When the printer 1 receives an image forming job from an external computer or the others, the sheet having a size designated by the image forming job is fed to the conveyance path from the sheet feeding cassette 3 or the manual bypass tray, and then sucked on the upper face of the conveyance belt by an air suction force of the air suction part. The recording heads 8Y, 8M, 8C and 8Y are suppled with the inks from the respective ink containers 10Y, 10M, 10C and 10K, and eject the inks on the sheet based on the image forming job to form an image on the sheet. The sheet on which the image is formed is discharged through the discharge port on the discharge tray.

Figure 4:
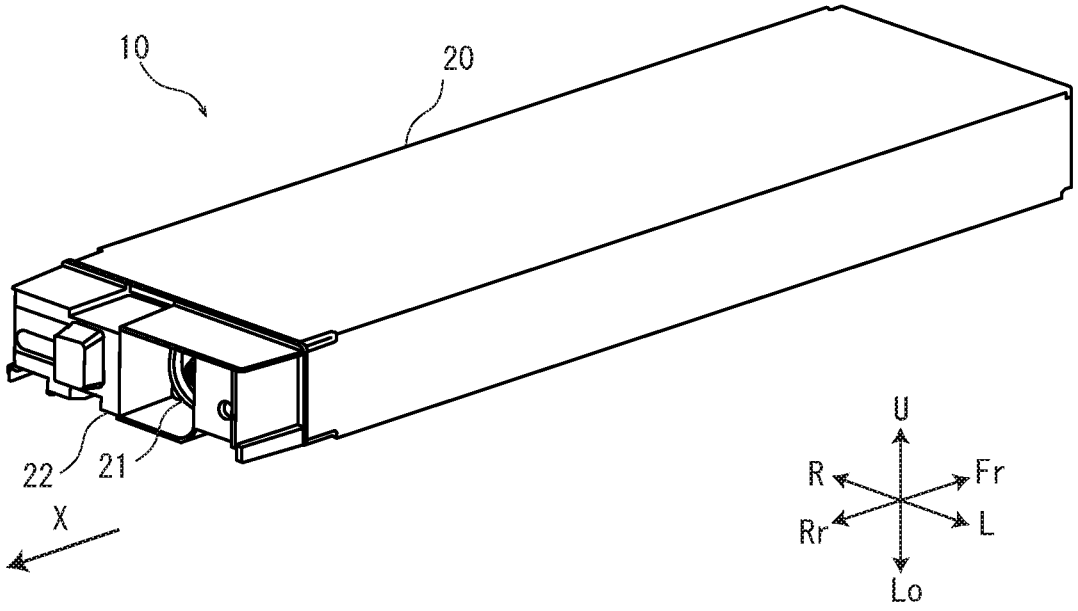
FIG. 4 is a perspective view showing an ink container according to the embodiment of the present disclosure.
Figure 5A:
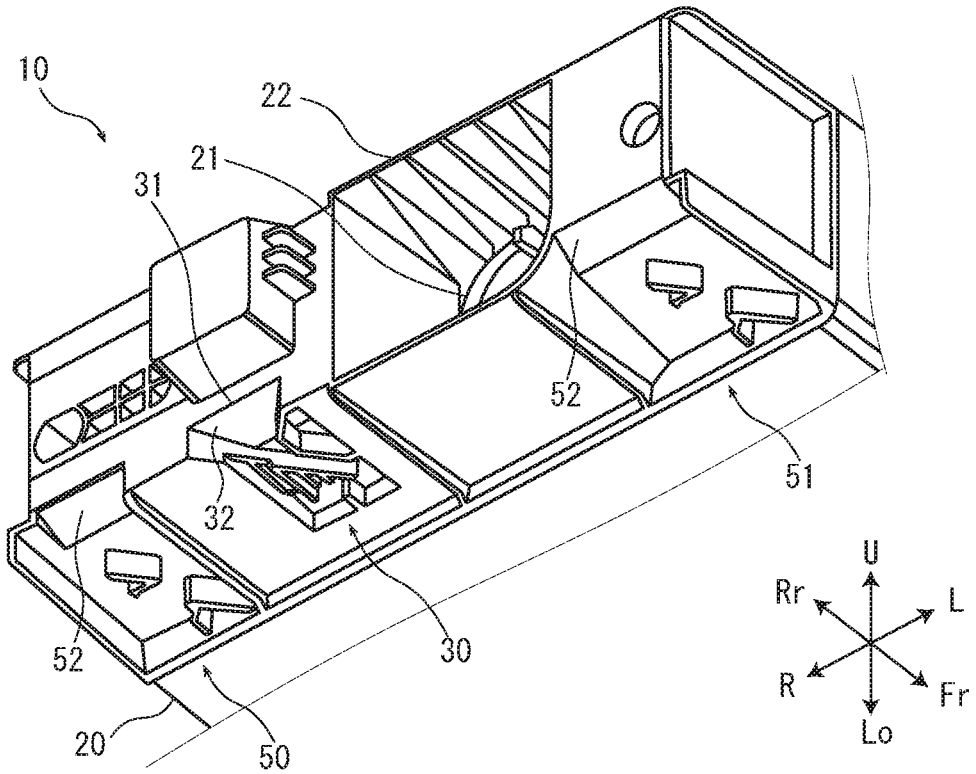
FIG. 5A is a perspective view showing the rear portion of the ink container according to the embodiment of the present disclosure.
Figure 5B:
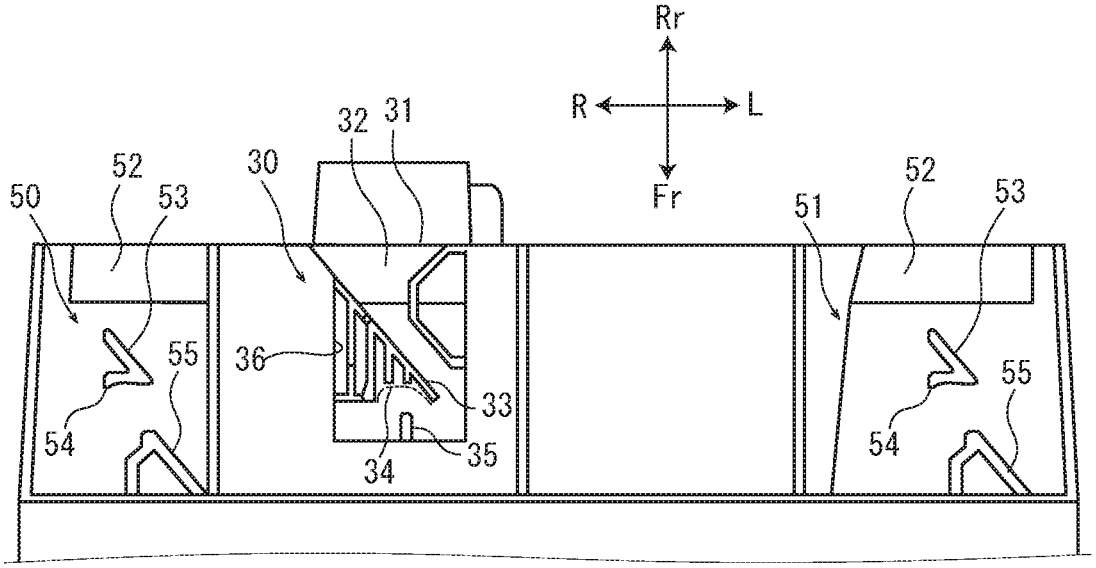
FIG. 5B is a plan view showing the lower face of the rear portion of the ink container according to the embodiment of the present disclosure.
Figure 6:
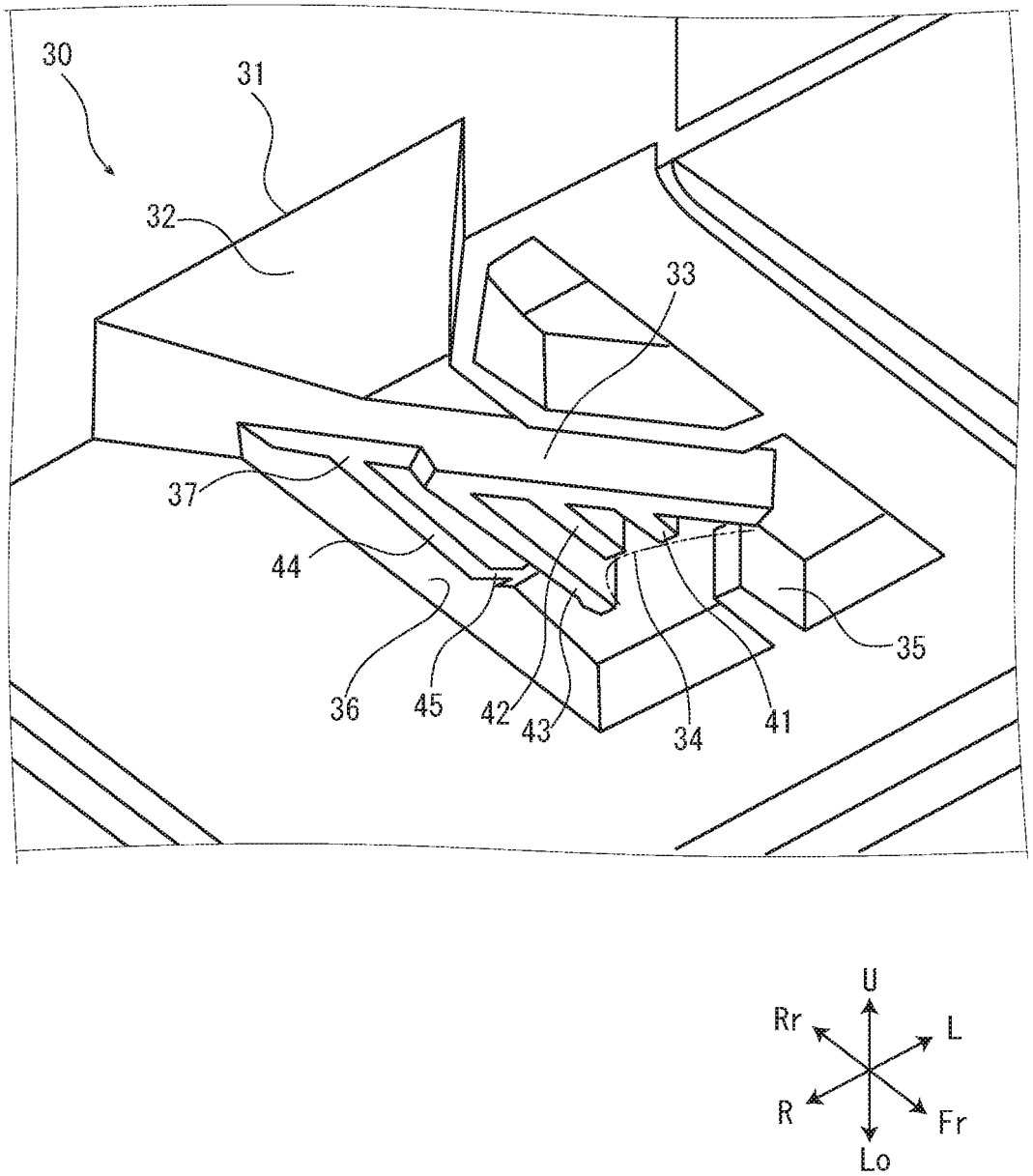
FIG. 6 is a perspective view showing a first lock part of the ink container according to the embodiment of the present disclosure.
Figure 7A:
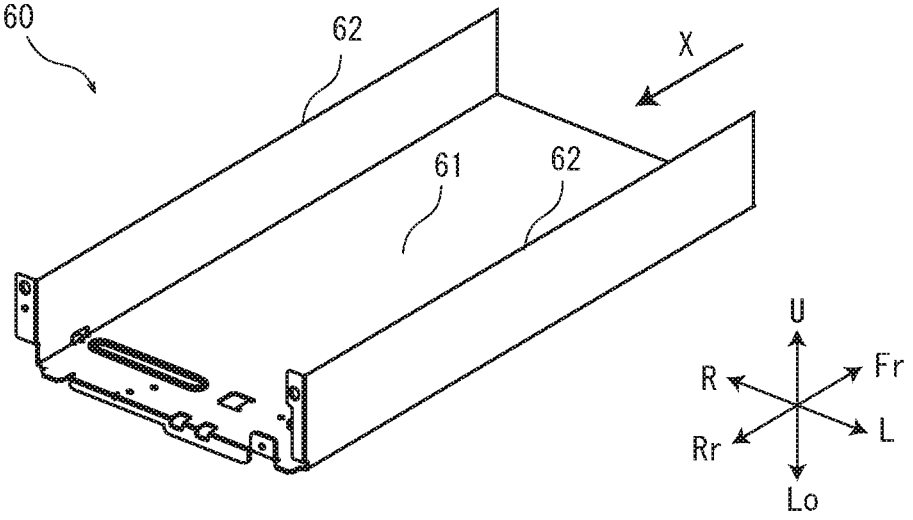
FIG. 7A is a perspective view showing a container guide of the ink container according to the embodiment of the present disclosure.
Figure 7B:
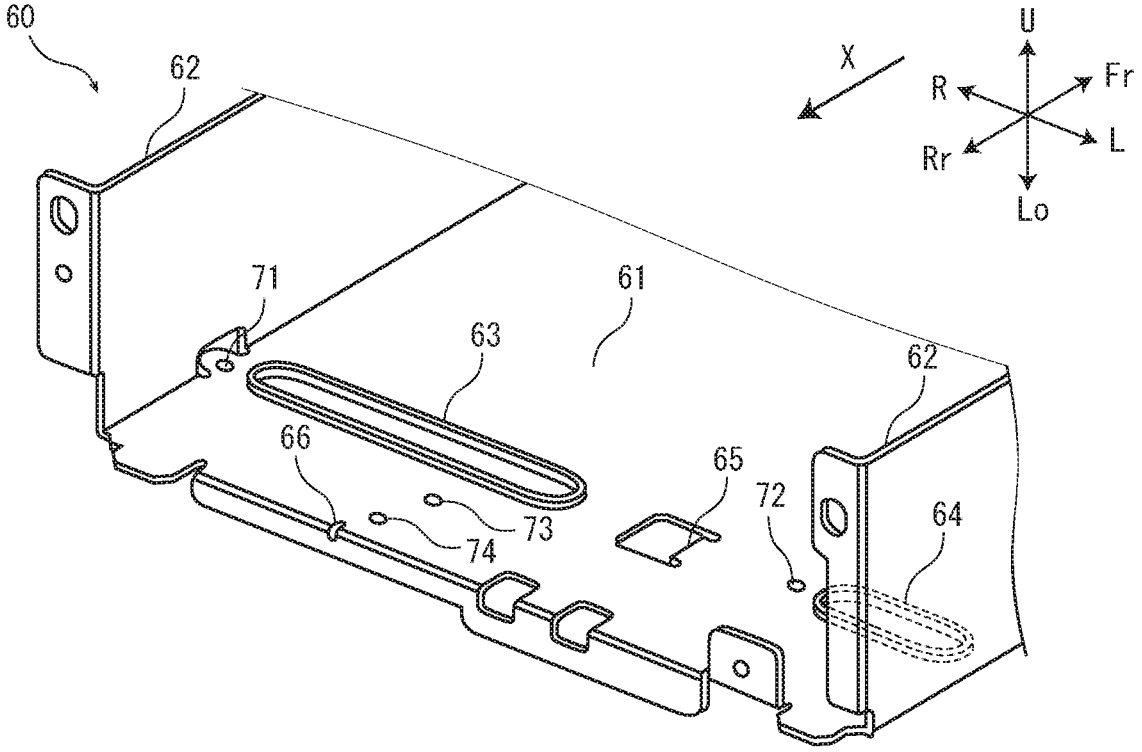
FIG. 7B is a perspective view showing the rear portion of the container guide of the ink container according to the embodiment of the present disclosure.
Figure 8A:
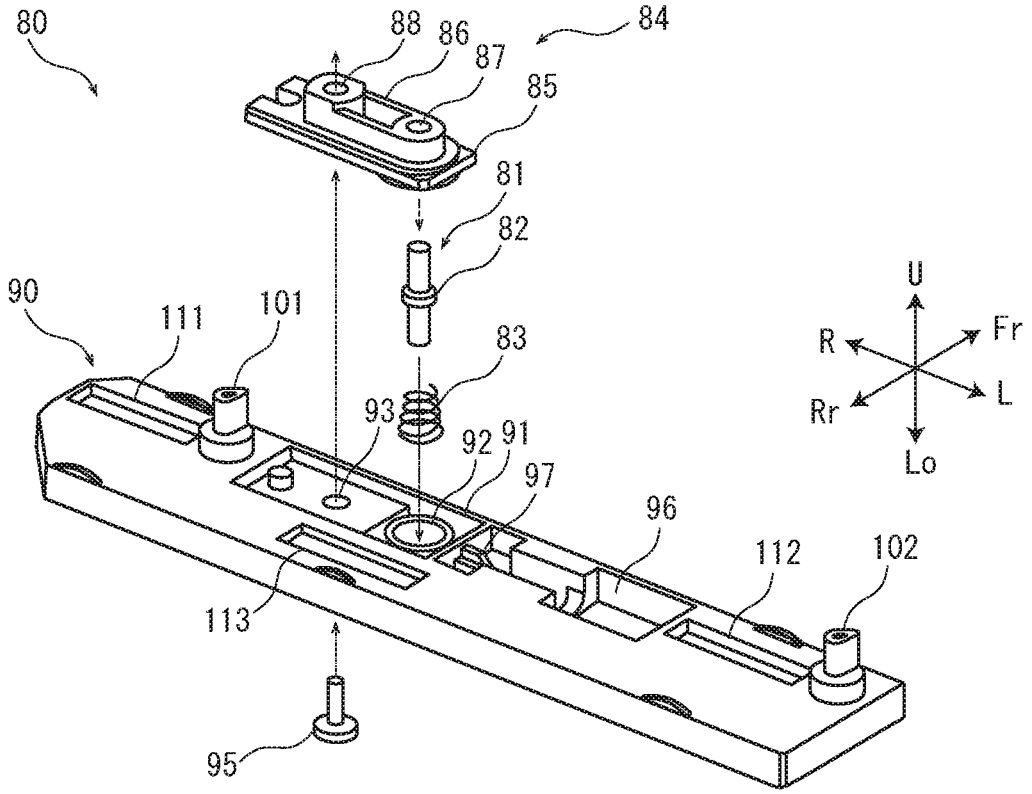
FIG. 8A is a disassembled view showing a latch unit of the ink container according to the embodiment of the present disclosure.
Figure 8B:
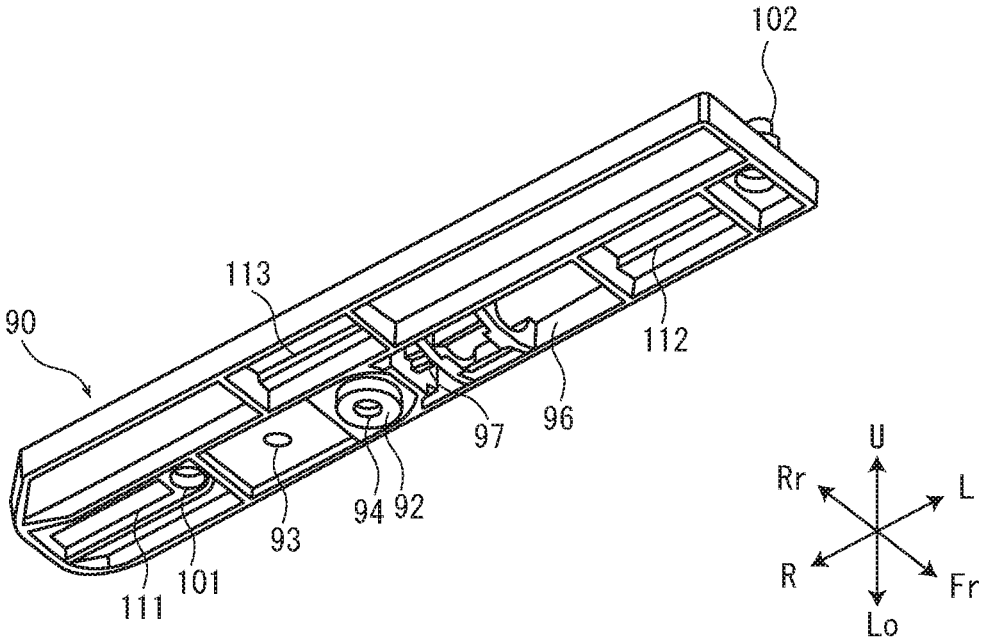
FIG. 8B is a perspective view showing the lower portion of a latch unit main body of the ink container according to the embodiment of the present disclosure.
Figure 9:
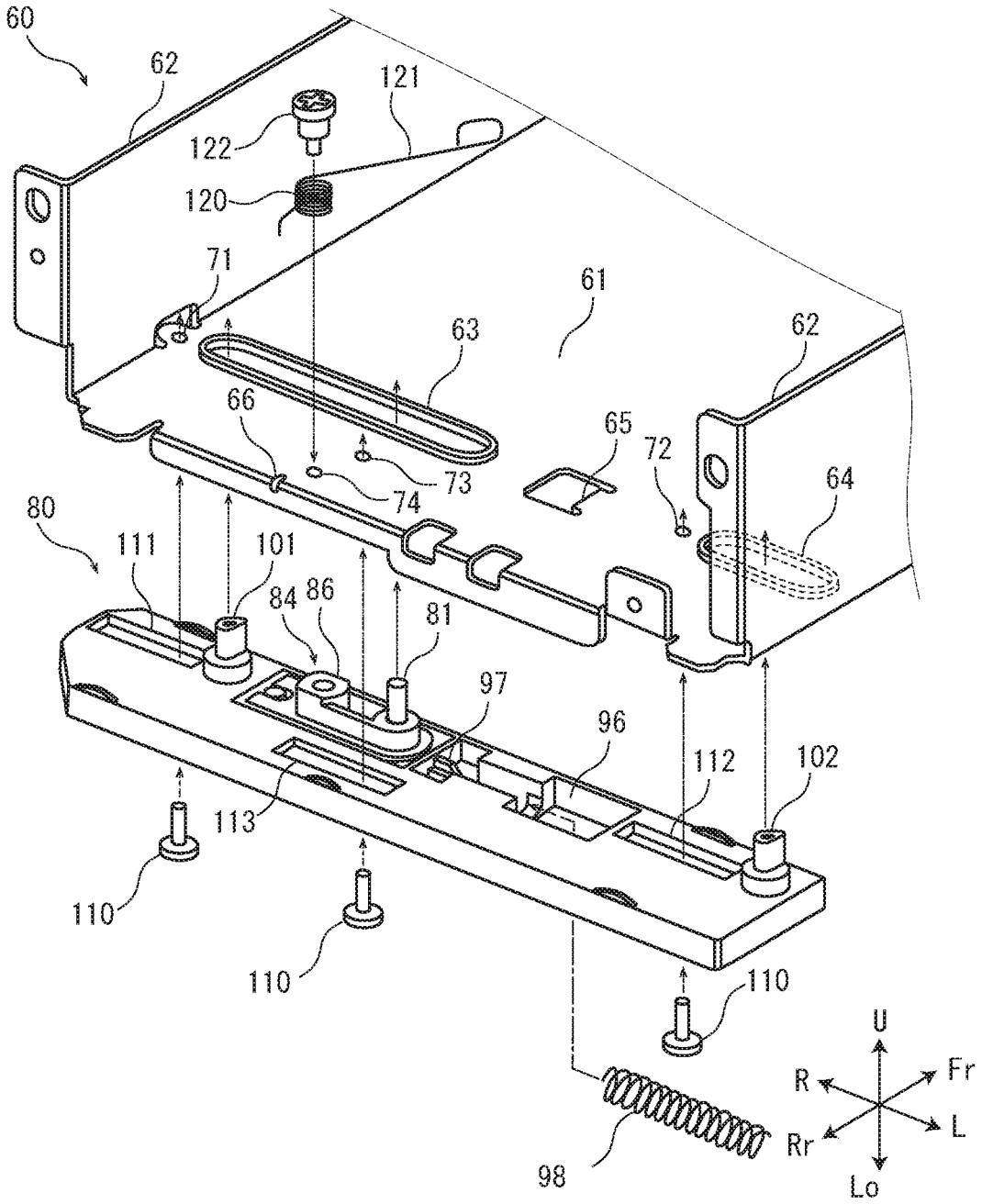
FIG. 9 is a perspective view showing a state where the latch unit is being attached to the container guide, in the ink container according to the embodiment of the present disclosure.
Figure 10:
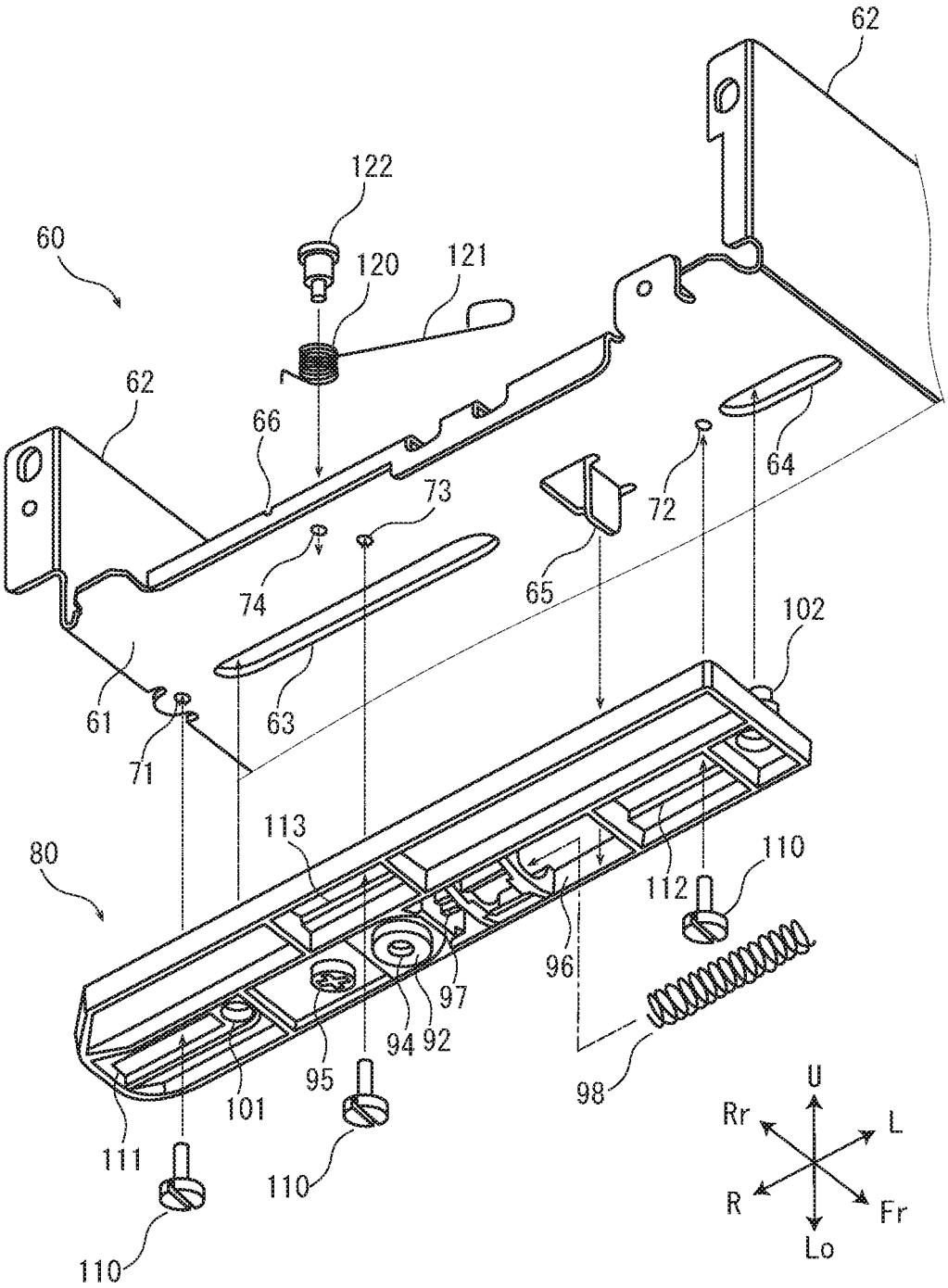
FIG. 10 is a perspective view showing a state where the latch unit is being attached to the container guide, in the ink container according to the embodiment of the present disclosure.
Figure 11A:
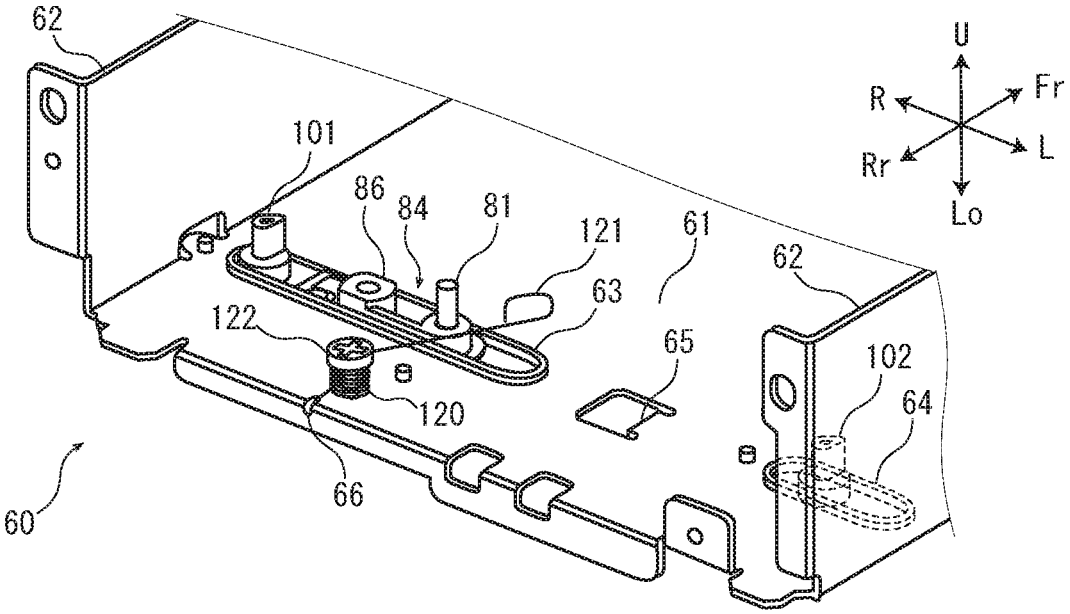
FIG. 11A is a perspective view showing a state where the latch unit is attached to the container guide, in the ink container according to the embodiment of the present disclosure.
Figure 11B:
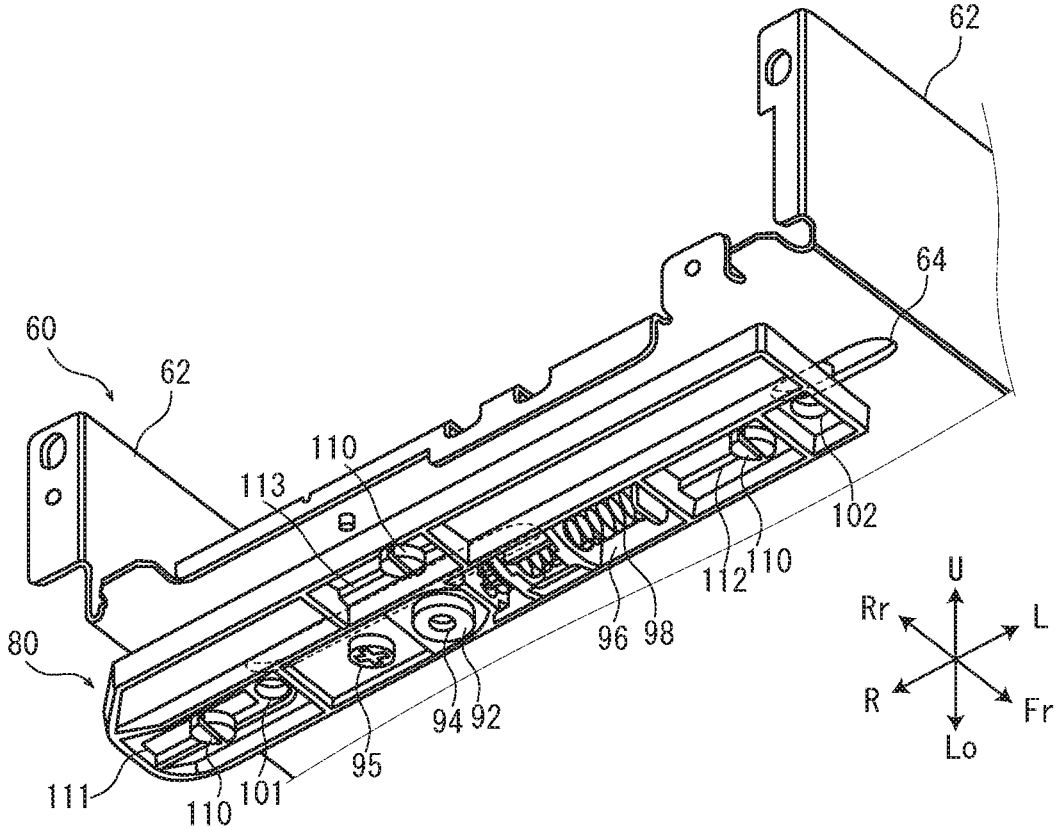
FIG. 11B is a perspective view showing a state where the latch unit is attached to the container guide, in the ink container according to the embodiment of the present disclosure.

Next, with reference to FIG. 3 to FIG. 11B, the structures of the ink container 10 and a container guide 60 will be described. FIG. 4 is a perspective view showing the ink container 10. FIG. 5A is a perspective view showing the rear portion of the ink container 10. FIG. 5B is a plan view showing the lower face of the rear portion of the ink container 10. FIG. 6 is a perspective view showing a first lock part 30 (an example of a latch mechanism). FIG. 7A is a perspective view showing the container guide 60. FIG. 7B is a perspective view showing the rear portion of the container guide 60. FIG. 8A is a disassembled view showing a latch unit 80 (an example of the latch mechanism). FIG. 8B is a perspective view showing a lower portion of a unit main body 90 (an example of a pin supporting member). FIG. 9 and FIG. 10 are perspective views showing a state there the latch unit 80 is being attached to the container guide 60. FIG. 11A and FIG. 11B are perspective views showing a state where the latch unit 80 is attached to the container guide 60.

The printer 1 includes the ink container 10, the container guide 60 and the latch unit 80. The ink container 10 stores the ink. The container guide 60 guides the ink container 10 in a predetermined attachment direction to be attached. The latch unit 80 performs the attachment and the detachment of the ink container 10 to and from the container guide 60 by pushing the ink container 10 in the predetermined attachment direction.

As shown in FIG. 4, the ink container 10 includes a case 20, a cap 21 and a cap supporting part 22. The case 20 is formed in a parallelepiped box-like shape whose longitudinal direction is along the front-and-rear direction. The cap supporting part 22 is provided in the rear end of the case 20, and the cap 21 is supported by the cap supporting part 22. Inside the case 20, an ink pack (not shown) which stores the ink and a spout (not shown) attached to the ink pack are provided, and the spout is connected to the cap 21. The ink pack is formed by flexible film material, and filled with the ink. The ink container 10 is attached to the container storage part 11 in a direction from the front side to the rear side of the container storage part 11 after the left lower cover 5 is opened (refer to FIG. 3). Hereinafter, the direction is called an attachment direction X. When the ink container 10 is attached to the container storage part 11, the cap 21 is connected to the connection port 14.

As shown in FIG. 5A and FIG. 5B, on the lower face of the rear portion of the ink container 10, a first lock part 30 and second lock parts 50 and 51 are provided. The first lock part 30 is provided at a position closer to the right side than the center portion in the left-and-right direction. The second lock parts 50 and 51 are formed at positions on both sides of the first lock part 30 in the left-and-right direction.

At a position closer to the right side than the center portion in the left-and-right direction in the lower end portion of the rear end of the ink container 10, an opening 31 is formed. On the ceiling portion of the opening 31, an inclined face 32 inclined downward from the rear side to the front side is formed. The opening 31 is formed such that a distance between the left and right wall faces is narrowed from the rear side to the front side. The first lock part 30 is formed across the inclined face 32 and the horizontal face on the front side of the inclined face 32. On both end portions in the left-and-right direction in the lower end portion of the rear end of the ink container 10, inclined faces 52 inclined downwardly from the rear side to the front side are formed. The second lock parts 50 and 51 are disposed on the front side of the inclined faces 52.

As shown in FIG. 5B and FIG. 6, the first lock part 30 includes a first guide part 33, a first storage part 34, a first auxiliary guide part 35 and a detachment guide part 36.

The first guide part 33 is a rib formed so as to extend from the right wall face of the opening 31 in the left front direction. On the front side of the first guide part 33, ribs 41, 42 and 43 formed so as to extend in the front-and-rear direction are provided side by side from the left side to the right side. The front end portions of the rib 41 and the rib 42 are positioned on the rear side of the front end portions of the first guide part 33 and the rib 43. The above arrangement forms the first storage part 34 recessed rearward as shown in a two-dotted chain line in FIG. 5B and FIG. 6. The first auxiliary guide part 35 is a rib formed so as to extend in the front-and-rear direction on the front side of the first storage part 34.

The detachment guide part 36 is a wall face formed so as to extend in the front-and-rear direction on the right side of the rib 43. Between the rib 43 and the detachment guide part 36, a rib 44 formed so as to extend in the front-and-rear direction is provided. The rib 44 has a height lower than heights of the rib 43 and the detachment guide part 36. At a crossing point of the rib 44 with the first guide part 33, the first guide part 33 has a notch 37 formed such that the height is equal to a height of the rib 44. In the front end portion of the rib 44, an inclined face 45 inclined downwardly from the front side to the rear side is formed.

The second lock part 50 and the second lock part 51 have the same structure. The second lock parts 50 and 51 each includes a second guide part 53, a second storage part 54 and a second auxiliary guide part 55. The second guide part 53 is a rib formed so as to extend in the left front direction. The second storage part 54 is a rib formed so as to extend from the front end portion of the second guide part 53 in the right direction. The front side face of the second storage part 54 is formed to be a recessed shape recessed rearwardly. The second auxiliary guide part 55 is a rib formed so as to extend in the left front direction on the front side of the second storage part 54.

As shown in FIG. 7A and FIG. 7B, the container guide 60 includes a bottom plate part 61 facing the lower face of the ink container 10 and two side plate parts 62 facing the left and right side faces of the ink container 10. In the rear portion of the bottom plate part 61, a guide hole 63 whose longitudinal direction is along the left-and-right direction and a guide hole 64 are formed. The guide hole 63 is formed from the left end portion to the center portion of the bottom plate part 61. The guide hole 64 is formed in the right end portion of the bottom plate part 61. Between the guide hole 63 and the guide hole 64, a cut-and-stood piece 65 protruding downward is formed. On the left side of the guide hole 63, between the guide hole 64 and the cut-and-stood piece 65 and on the rear side of the guide hole 63, screw holes 71, 72 and 73 are respectively formed. Along the edge of the rear end of the bottom plate part 61, a notch 66 is formed. On the front side of the notch 66, a screw hole 74 is formed.

As shown in FIG. 8A, the latch unit 80 includes the unit main body 90, a pin 81, a coil spring 83 and a cover 84. The unit main body 90 is an approximately parallelepiped member whose longitudinal direction is along the left-and-right direction. The pin 81 is a rod-like member whose longitudinal direction is along the upper-and-lower direction, and has a flange 82 in the center portion in the upper-and-lower direction. The cover 84 has a base portion 85 whose longitudinal direction is along the left-and-right direction, and a protruding portion 86 having a width corresponding to a width in the front-and-rear direction of the guide hole 63 is formed in the upper portion of the base portion 85. In the protruding portion 86, a pin hole 87 through which the upper portion of the pin 81 is inserted and a screw hole 88 on the right side of the pin hole 87 are formed. On a portion closer to the right side than the center portion in the left-and-right direction on the upper face of the unit main body 90, a recess 91 into which the cover 84 is fitted is formed. The recess 91 includes a storage recess 92 in which the coil spring 83 is stored and a screw hole 93 corresponding to the screw hole 88 are formed. As shown in FIG. 8B, the storage recess 92 has a pin hole 94 into and from which the lower end portion of the pin 81 is inserted and drawn.

On the right side of the recess 91 and in the left end portion of the unit main body 90, bosses 101 and 102 protruding upwardly are provided respectively. That is, the bosses 101 and 102 are formed at the end portions on the both sides of the pin 81 in the left-and-right direction (a direction perpendicular to the attachment direction X). In the right end portion of the unit main body 90, on the right side of the boss 102 and on the rear side of the recess 91, slits 111, 112 and 113 whose longitudinal direction is along the left-and-right direction are formed respectively. Between the recess 91 and the slit 112, a spring storage part 96 having a space whose longitudinal direction is along the left-and-right direction is formed. In the right end of the spring storage part 96, a protrusion 97 protruding leftward is formed.

The coil spring 83 is inserted into the storage recess 92, the lower portion of the pin 81 is inserted into the coil spring 83, the upper portion of the pin 81 is inserted into the pin hole 87, the cover 84 is fitted into the recess 91 and a screw 95 is fastened to the screw hole 93 and the screw hole 88. Then, the cover 84 is fixed to the unit main body 90. When the cover 84 is fixed, the coil spring 83 is compressed. When the pin 81 is pushed downward, the pin 81 is biased upwardly.

As shown in FIG. 9 to FIG. 11B, the latch unit 80 is mounted on the rear portion of the lower face of the bottom plate part 61 of the container guide 60 by using sliding pins 110. At this time, the protruding portion 86 of the cover 84 and the boss 101 are inserted into the guide hole 63, the boss 102 is inserted into the guide hole 64 and the cut-and-stood piece 65 is inserted into the spring storage part 96. The pin 81, the boss 101 and the boss 102 are protruded to the lower face of the ink container 10. The sliding pin 110 has a shaft portion and a head portion. The shaft portion has a diameter smaller than a width in the front-and-rear direction of the slits 111, 112 and 113. The head portion has a diameter larger than a width in the front-and-rear direction of the slits 111, 112 and 113. The sliding pins 110 are fastened to the screw hole 71, 72 and 73 through the slit 111, 112 and 113 respectively. Then, the latch unit 80 is mounted to the container guide 60. The above configuration makes the latch unit 80 to be movable in the longitudinal direction of the slits 111, 112 and 113, that is, in a direction parallel to the lower face of the ink container 10 and crossing to the attachment direction X.

In the spring storage part 96, a compressed coil spring 98 is stored. The protrusion 97 of the spring storage part 96 is inserted into the right end of the coil spring 98, and the left end of the coil spring 98 is pressed against the cut—and stood piece 65.

When an external force in the left-and-right direction is applied to the latch unit 80, the latch unit 80 is slid in a direction corresponding to the external force. At this time, the boss 101 and the protruding portion 86 of the cover 84 are slid along the guide hole 63, and the boss 102 is slid along the guide hole 64. When the latch unit 80 is slid rightward, the latch unit 80 is biased leftward by the coil spring 98.

In one end of the coil of a torsion coil spring 120, a straight lever part 121 is formed. A screw 122 has a shaft portion, a large diameter portion and a head portion. The large diameter portion has an outer diameter larger than the shaft portion and corresponding to an inner diameter of the coil. The large diameter portion of the screw 122 is inserted into the inside of the coil, the other end of the coil is inserted to the notch 66 of the bottom plate part 61 and the screw 122 is fastened to the screw hole 74. Then, the torsion coil spring 120 is mounted to the container guide 60. When the ink container 10 is not attached, the tip end portion of the lever part 121 is positioned on the left front side with respect to the screw hole 74.

Next, with reference to FIG. 12A to FIG. 15A, a process to attach the ink container will be described.

Figure 12A:
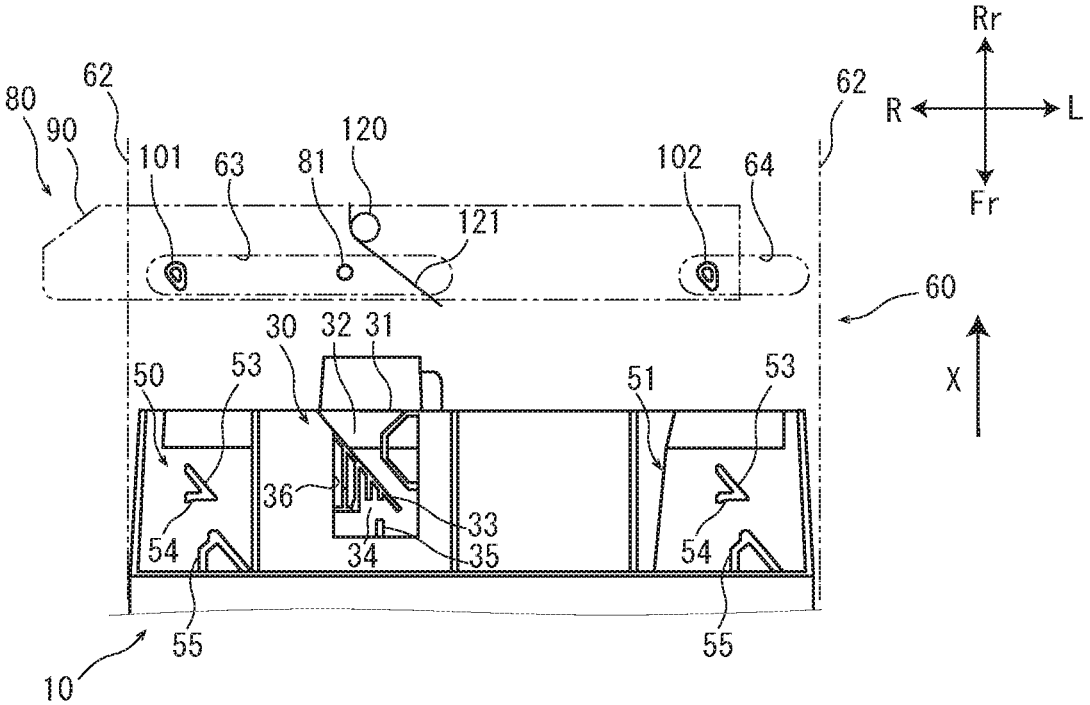
FIG. 12A is a plan view showing a state where the ink container is pushed into the container guide, in the ink container according to the embodiment of the present disclosure.

Firstly, a user opens the left lower cover 5, holds the ink container 10, inserts the rear end portion of the ink container 10 into the front end portion of the container guide 60, and then, as shown in FIG. 12A, pushes the ink container 10 rearward (in the attachment direction X). Then, the rear end portion of the ink container 10 comes into contact with the tip end portion of the lever part 121 of the torsion coil spring 120, and the ink container 10 is biased frontward (a direction opposite to the attachment direction X) by the torsion coil spring 120.

Figure 12B:
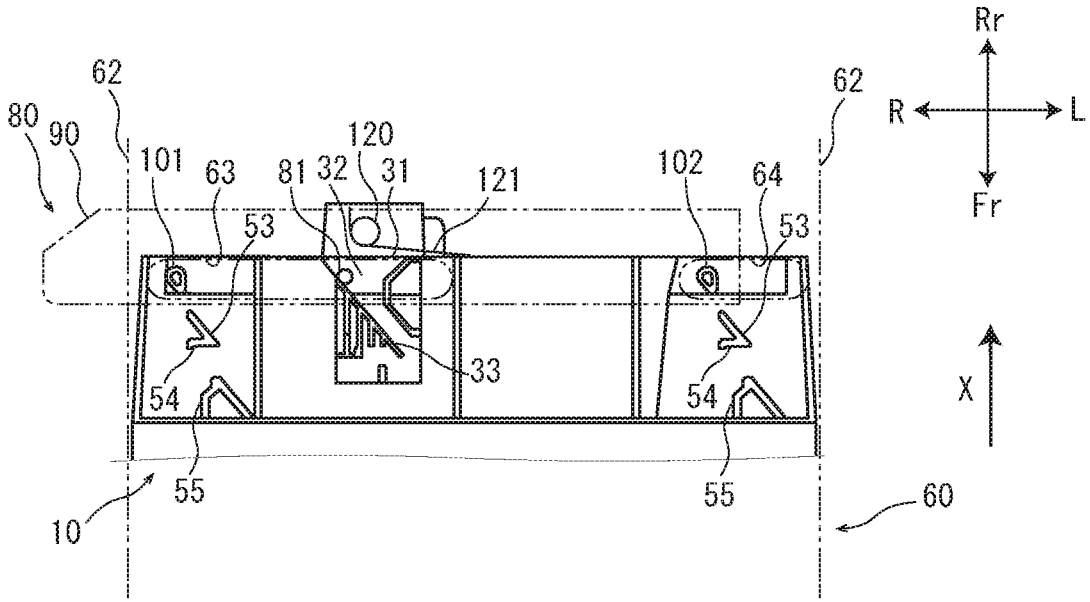
FIG. 12B is a plan view showing a state where a first guide part is pressed against a side face of a pin, in the ink container according to the embodiment of the present disclosure.

When the user pushes the ink container 10 rearward against a biasing force of the torsion coil spring 120, as shown in FIG. 12B, the first guide part 33 of the first lock part 30 is pressed against the side face of the pin 81 of the latch unit 80. At this time, the inclined face 32 of the opening 31 is pressed against the upper end portion of the pin 81.

Figure 13A:
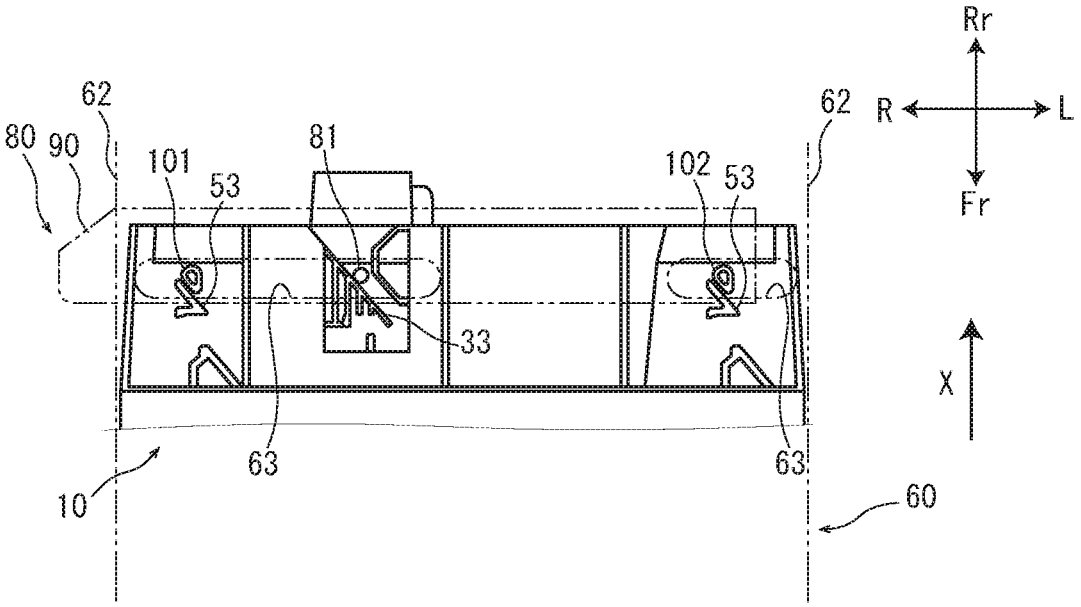
FIG. 13A is a plan view showing a state where the first guide part pushes out the pin and a second guide part pushes out a boss, in the printer according to the embodiment of the present disclosure.

As the ink container 10 is pushed rearward, as shown in FIG. 13A, the first guide part 33 pushes the pin 81 leftward while sliding with respect to the side face of the pin 81. In parallel, the second guide parts 53 of the second lock parts 50 and 51 push the bosses 101 and 102 leftward while sliding with respect to the side faces of the bosses 101 and 102 respectively. Additionally, the inclined face 32 of the opening 31 pushes the pin 81 downward while sliding with respect to the upper end portion of the pin 81. At this time, the latch unit 80 is biased rightward, and the pin 81 is biased upward. The torsion coil spring 120 is not shown in FIG. 13A to FIG. 15A.

Figure 13B:
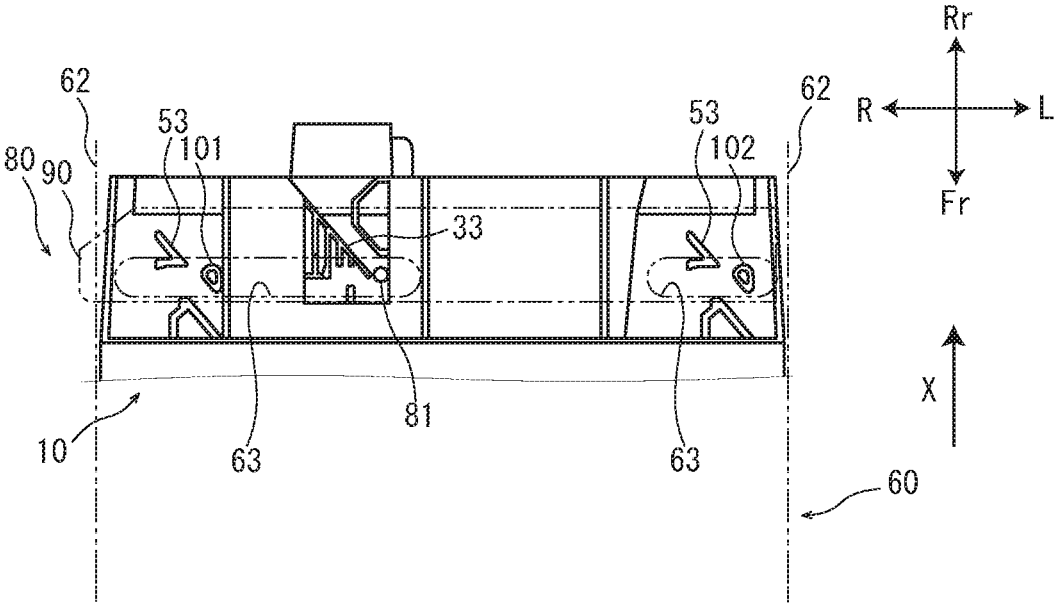
FIG. 13B is a plan view showing a state where the pin reaches the front end portion of the first guide part, in the ink container according to the embodiment of the present disclosure.

FIG. 13B shows a state where the pin 81 pushed out by the first guide part 33 reaches the front end portion of the first guide part 33. At this time, the bosses 101 and 102 are positioned on the left front side with respect to the second guide part 53.

Figure 14A:
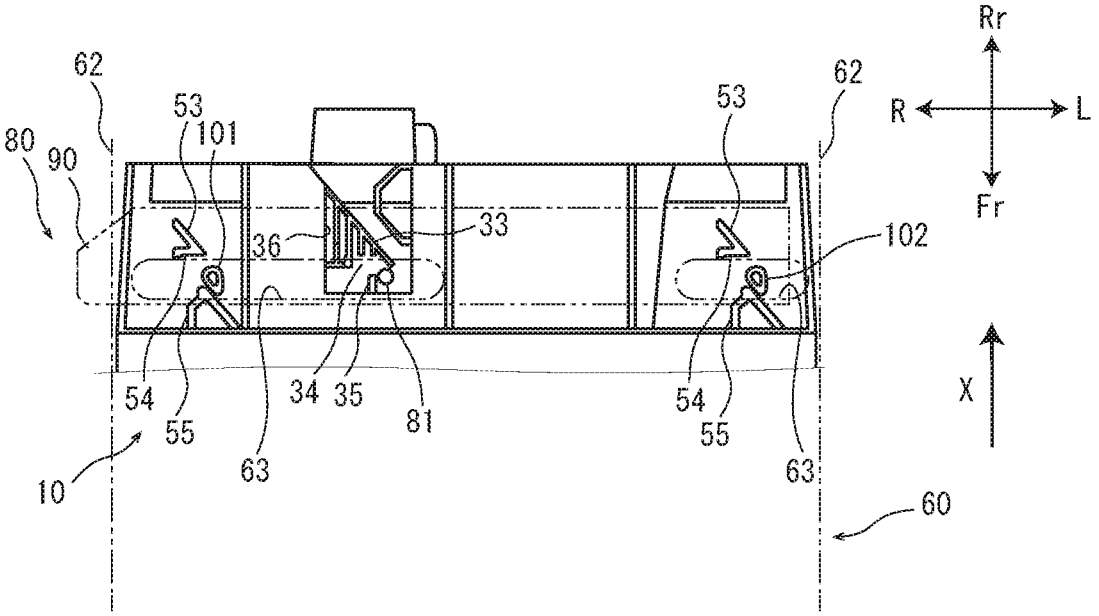
FIG. 14A is a plan view showing a state where the pin is pressed against a first auxiliary guide part and the boss is pressed against a second auxiliary guide part, in the ink container according to the embodiment of the present disclosure.

When the user pushes the ink container 10 further rearward, because the latch unit 80 is biased rightward, as shown in FIG. 14A, the pin 81 gets over the front end portion of the first guide part 33 and is pressed against the first auxiliary guide part 35, and the bosses 101 and 102 are pressed against the second auxiliary guide part 55.

Figure 14B:
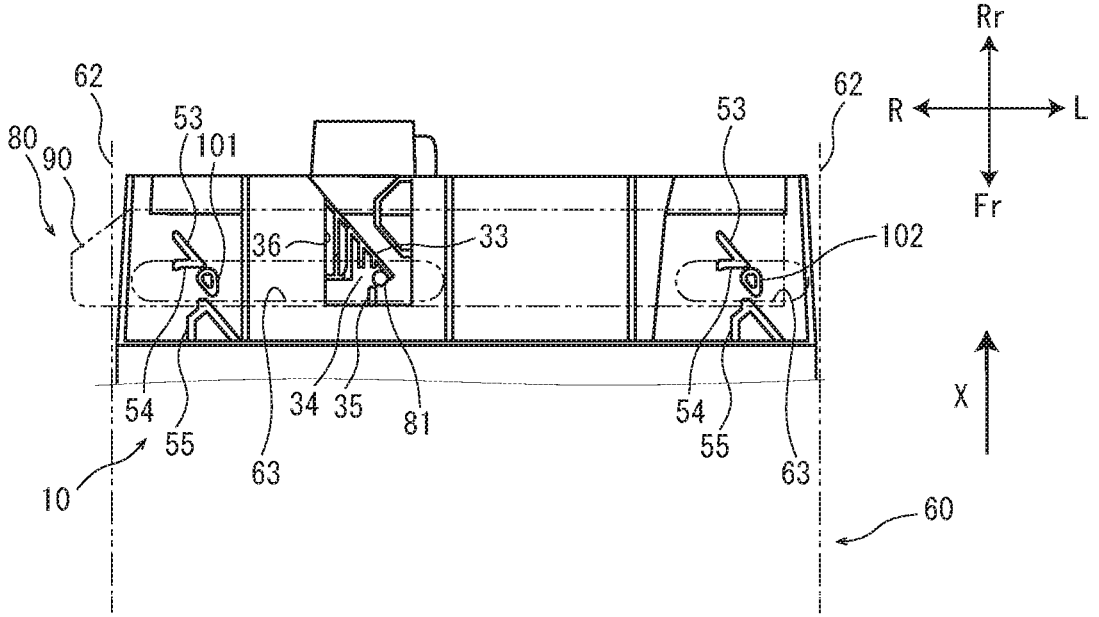
FIG. 14B is a plan view showing a state where the pin enters a space between the first guide part and the first auxiliary guide part and the boss enters a space between the second guide part and the second auxiliary guide part, in the ink container according to the embodiment of the present disclosure.
Figure 15A:
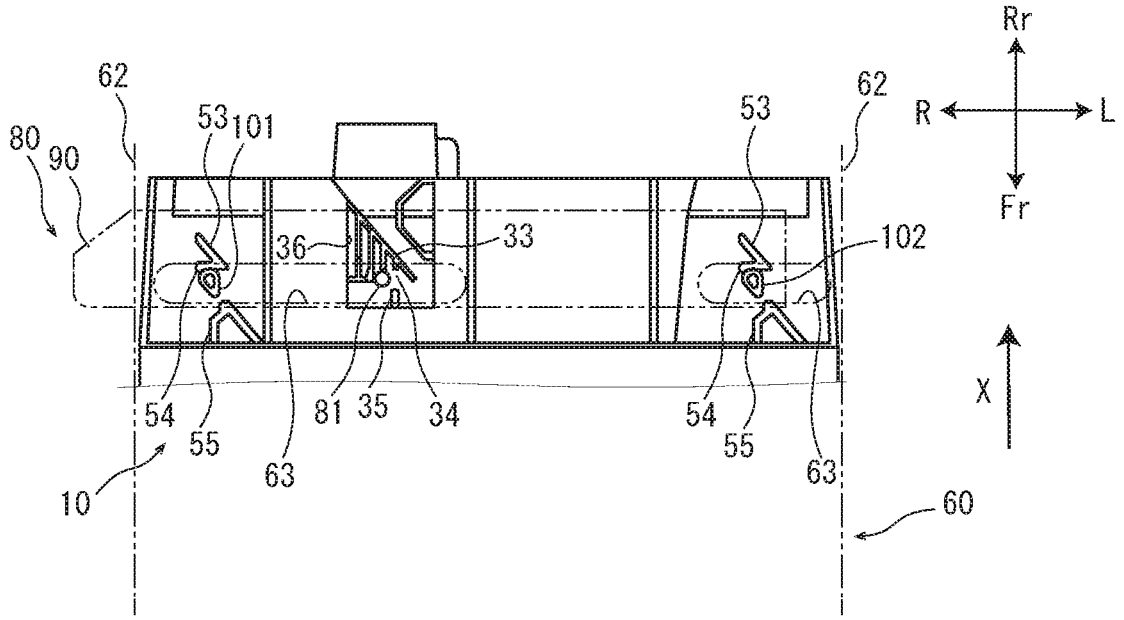
FIG. 15A is a plan view showing a state where the pin enters a first storage part and the boss enters a second storage part, in the ink container according to the embodiment of the present disclosure.

When the user stops the pushing of the ink container 10, because the ink container 10 is biased forward, the ink container 10 is pushed back forward. Then, as shown in FIG. 14B, the pin 81 enters a space between the first guide part 33 and the first auxiliary guide part 35, and then the bosses 101 and 102 enter a space between the second guide part 53 and the second auxiliary guide part 55. Then, because the latch unit 80 is biased rightward, as shown in FIG. 15A, the pin 81 is stored in the first storage part 34 and the bosses 101 and 102 are stored in the second storage part 54. Because the pin 81 is biased upward and the ink container 10 is biased forward, the pin 81 is restrained by the first storage part 34 and the bosses 101 and 102 are restrained by the second storage part 54. As a result, the ink container 10 is attached to the container guide 60.

Next, with reference to FIG. 15B to FIG. 17, a process to detach the ink container 10 will be described. The torsion coil spring 120 is not shown in FIG. 15B to FIG. 16B.

Figure 15B:
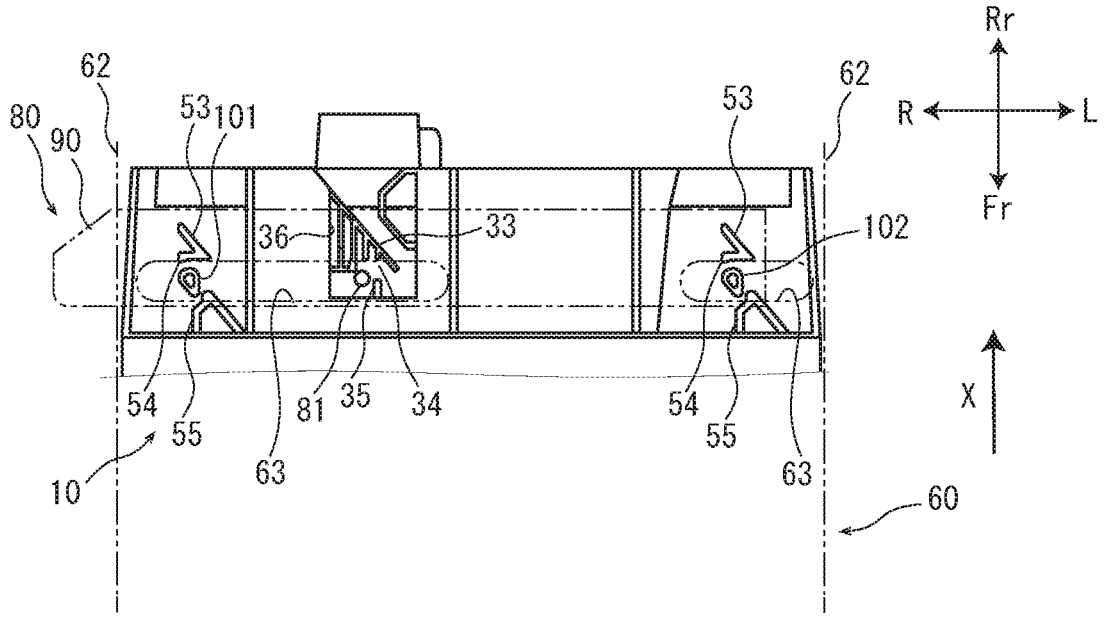
FIG. 15B is a plan view showing a state where the first storage part separates from the pin and the second storage part separates from the boss, in the ink container according to the embodiment of the present disclosure.
Figure 16A:
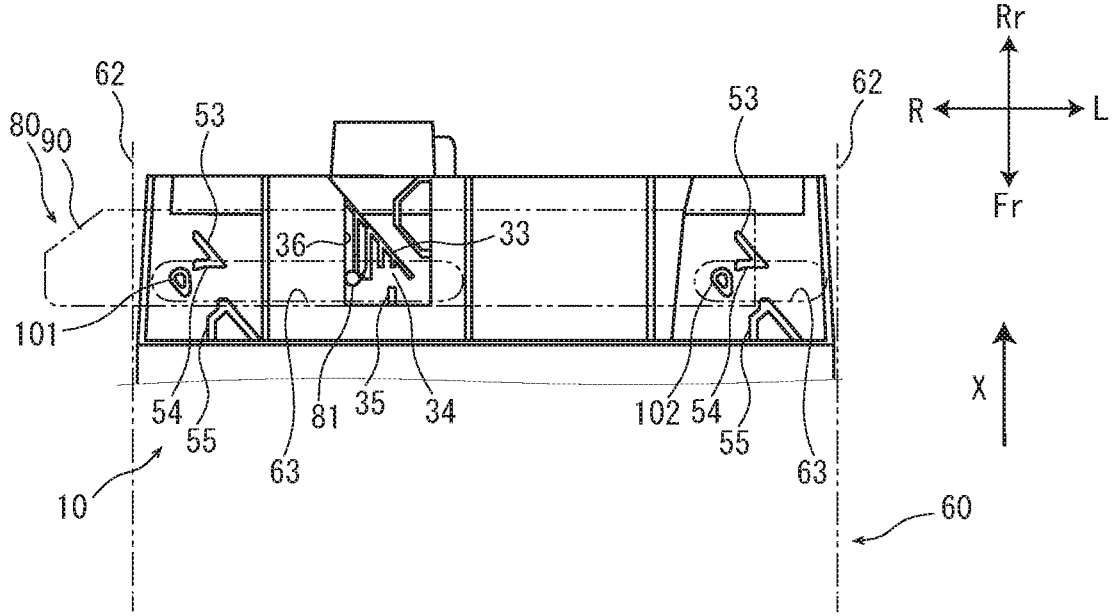
FIG. 16A is a plan view showing a state where the pin is pressed against a detachment guide part, in the ink container according to the embodiment of the present disclosure.

When the user pushes the ink container 10 rearward against the biasing force of the torsion coil spring 120, as shown in FIG. 15B, the first storage part 34 is displaced rearward to be separated from the pin 81, and the second storage part 54 is displaced rearward to be separated from the bosses 101 and 102. Then, because the latch unit 80 is biased rightward, as shown in FIG. 16A, the pin 81 is removed from the first storage part 34 to be pushed out rightward and pressed against the detachment guide part 36. The bosses 101 and 102 are removed from the second storage part 54 to be pushed out rightward. At this time, the upper end of the pin 81 is pressed against the inclined face 45 of the rib 44.

Figure 16B:
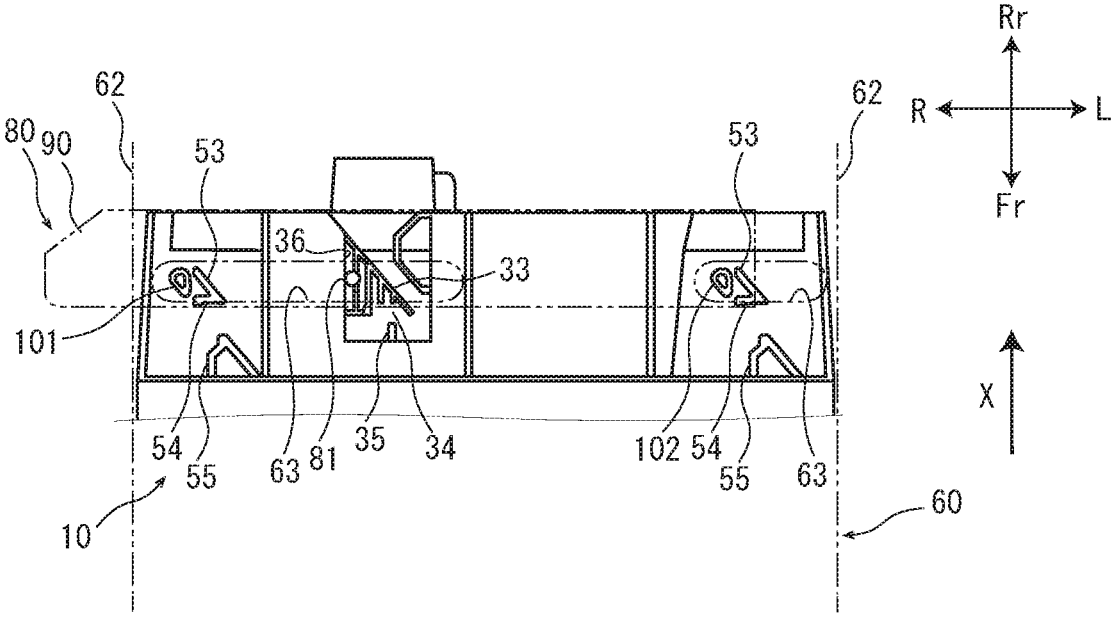
FIG. 16B is a plan view showing a state where the ink container is pushed back while the detachment guide part sliding with respect to the side face of the pin, in the ink container according to the embodiment of the present disclosure.
Figure 17:
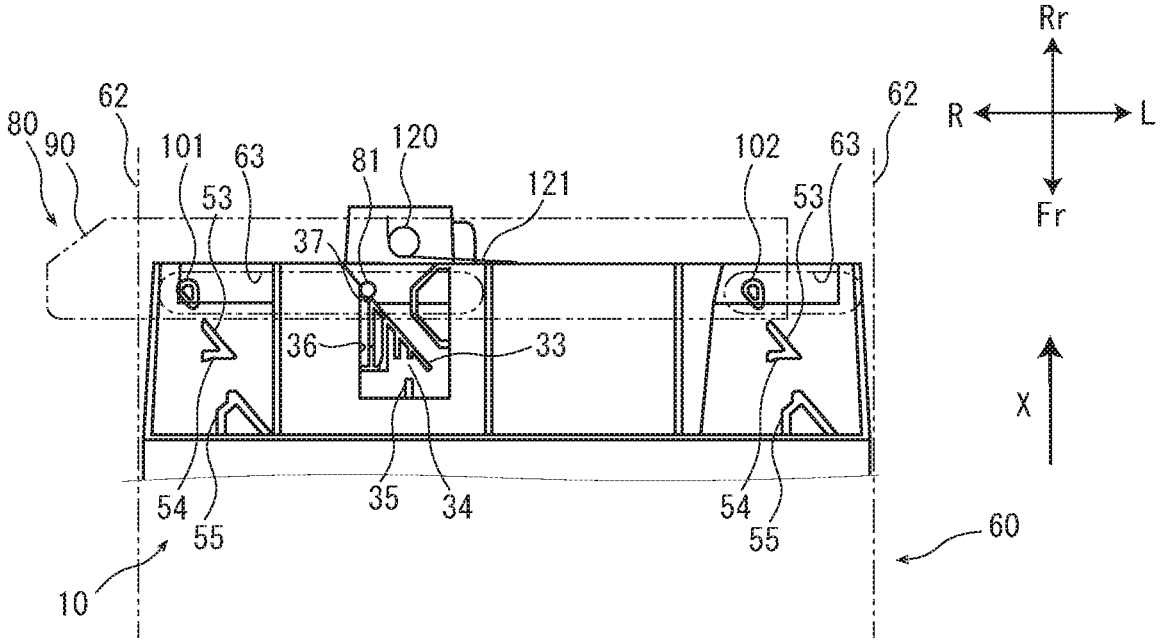
FIG. 17 is a plan view showing a state where a notch of the first guide part is passed through a position of the pin, in the ink container according to the embodiment of the present disclosure.

When the user stops the pushing of the ink container 10, because the ink container 10 is biased forward, as shown in FIG. 16B, the ink container 10 is pushed back forward while the detachment guide part 36 sliding with respect to the side face of the pin 81. At this time, the inclined face 45 of the rib 44 is slid with respect to the upper end of the pin, then the lower face of the rib 44 on the rear side of the inclined face 45 is slid with respect to the upper end of the pin 81, and then, as shown in FIG. 17, the notch 37 of the first guide part 33 is passed through a position of the pin 81. The second storage part 54 and the second guide part 53 are displaced forward on the left sides of the bosses 101 and 102. Finally, the user draws out the ink container 10 from the container guide 60. Then, the ink container 10 is detached from the container guide 60.

According to the printer 1 and the ink container 10 according to the above described present embodiment, the latch unit 80 is provided with the bosses 101 and 102 in addition to the pin 81 and the ink container 10 is provided with the second storage part 54 in addition to the first storage part 34 so that a load hardly concentrates at the pin 81 compared with a case where the bosses 101 and 102 and the second storage part 54 are not provided. According to the present embodiment, compared with the case where the bosses 101 and 102 and the second storage part 54 are not provided, a posture of the ink container 10 is hard to be inclined even if the ink container 10 has a wide width. Accordingly, according to the present embodiment, the ink container 10 and the printer 1 can be provided, in which the ink container 10 can be attached and detached by pushing the ink container 10 in the attachment direction X, a load hardly concentrates at the pin 81 which fixes the ink container 10, and the posture is hardly inclined even if it has a wide width.

According to the present embodiment, compared with a case where the bosses 101 and 102 and the second storage part 54 are provided at only one position, a load hardly concentrates at the pin 81 and the posture is hard to be inclined even if the ink container 10 has a wide width.

According to the present embodiment, compared with a case where the bosses 101 and 102 are not provided at positions on the both sides of the pin 81, the posture of the ink container 10 is hard to be inclined even if the ink container 10 has a wide width.

According to the present embodiment, compared with a case where the first guide part 33 and the second guide part 53 are not provided, it becomes possible to stably guide the pin 81, and the bosses 101 and 102 to the first storage part 34 and the second storage part 54 respectively.

The above embodiment may be modified as follows.

The above embodiment shows an example where the bosses 101 and 102 and the corresponding second lock parts 50 and 51 are provided; however, the boss may be provided at one position and the second lock part may be provided at the corresponding position.

Alternatively, the bosses may be provided at three or more positions and the second storage parts may be provided at the corresponding positions.

The above embodiment shows an example where the bosses 101 and 102 are formed at two positions on the both sides of the pin 81; however, the two bosses may be provided at other than the two positions on the both sides of the pin 81.

The above embodiment shows an example where the bosses 101 and 102 are formed at two positions on the both sides of the pin 81 in the left-and-right direction; however, the two bosses may be formed at two positions on the both sides of the pin 81 in a direction other than the left-and-right direction.

The above embodiment shows an example where the first storage part 34 is formed by the first guide part 33, the ribs 41, 42 and 43; however, the first storage part 34 may be a rib formed so as to extend rightward from the front end portion of the first guide part 33 in the same manner as the second storage part 54.

The above embodiment shows an example where the latch mechanism formed by the pin 81 and the first lock part 30 is provided; however, the latch mechanism is only one example. Any latch mechanism may be employed, as long as it includes a pin 81 protruding toward one face of the ink container 10 and a pin supporting member 90 supporting the pin 81 and supported by the container guide 60 in a movable manner in a direction parallel to the one face of the ink container 10 and crossing to the attachment direction X, permits the attachment of the ink container 10 to the container guide 60 when the ink container 10 is pushed along the container guide 60 in the attachment direction X and then the pin 81 is stored in the first storage part 34 formed in the ink container 10 and permits the detachment of the ink container 10 from the container guide 60 when the ink container 10 attached to the container guide 60 is pushed in the attachment direction X and then the pin 81 is removed from the first storage part 34. For example, a one-push type fixing member may be employed as the latch mechanism.

The above embodiment shows an example where the attachment direction X of the ink container 10 is a direction from the front side to the rear side of the housing 2; however the attachment direction X may be any directions. For example, the attachment direction X may be a direction from the upper side to the lower side of the housing 2.

Although the present disclosure described the specific embodiment, the present disclosure is not limited to the embodiment. It is to be noted that one skilled in the art can modify the embodiment without departing from the scope and spirit of the present disclosure.

The invention claimed is:

1. An image forming apparatus comprising:

a container guide which guides an ink container storing an ink supplied to a recording head in a predetermined attachment direction to be attached; and a latch mechanism including a pin protruding toward one face of the ink container and a pin supporting member supporting the pin and supported by the container guide in a movable manner in a direction parallel to the one face and crossing to the attachment direction, the latch mechanism permitting an attachment of the ink container to the container guide when the ink container is pushed along the container guide in the attachment direction and then the pin is stored in a first storage part formed in the ink container and permitting a detachment of the ink container from the container guide when the ink container attached to the container guide is pushed in the attachment direction and then the pin is removed from the first storage part, wherein the pin supporting member includes at least one boss protruding toward the one face of the ink container, and the ink container includes a second storage part formed on the one face of the ink container, and wherein the at least one boss is stored in the second storage part when the pin is stored in the first storage part, and the at least one boss is removed from the second storage part when the pin is removed from the first storage part.

2. The image forming apparatus according to claim 1, wherein the at least one boss contains two bosses, and the two bosses are formed at end portions on both sides of the pin in the direction crossing to the attachment direction.

3. The image forming apparatus according to claim 1, wherein the second storage part is a rib formed on the one face of the ink container along the direction crossing to the attachment direction.

4. The image forming apparatus according to claim 1, comprising:

a first guide part guiding the pin to the first storage part when the ink container is pushed in the attachment direction; and a second guide part guiding the boss to the second storage part when the ink container is pushed in the attachment direction.

5. The image forming apparatus according to claim 4, wherein the first guide part and the second guide part are ribs formed on the one face of the ink container so as to be inclined with respect to the attachment direction, and the second guide part and the second storage part are formed integrally.

6. The image forming apparatus according to claim 1, wherein the attachment direction is a horizontal direction, and the one face of the ink container is a lower face of the ink container.

7. An ink container attached to an image forming apparatus, wherein the image forming apparatus includes:

a container guide which guides an ink container storing an ink supplied to a recording head in a predetermined attachment direction to be attached;

a latch mechanism including a pin protruding toward one face of the ink container and a pin supporting member supporting the pin and supported by the container guide in a movable manner in a direction parallel to the one face and crossing to the attachment direction, the latch mechanism permitting an attachment of the ink container to the container guide when the ink container is pushed along the container guide in the attachment direction and then the pin is stored in a first storage part formed in the ink container and permitting a detachment of the ink container from the container guide when the ink container attached to the container guide is pushed in the attachment direction and then the pin is removed from the first storage part; and at least one boss formed in the pin supporting member so as to protrude toward the one face of the ink container, wherein the ink container includes:

a first storage part; and a second storage part formed on the one face of the ink container, wherein the at least one boss is stored in the second storage part when the pin is stored in the first storage part, and the at least one boss is removed from the second storage part when the pin is removed from the first storage part.

* * * * *